US007575420B2

(12) United States Patent
Ide et al.

(10) Patent No.: US 7,575,420 B2
(45) Date of Patent: Aug. 18, 2009

(54) VANE PUMP

(75) Inventors: Norikazu Ide, Tokyo (JP); Ryouichi Nagasaka, Tokyo (JP); Shinji Yakabe, Tokyo (JP)

(73) Assignee: Kayaba Industry Co., Ltd., Tokyo (JP)

( * ) Notice: Subject to any disclaimer, the term of this patent is extended or adjusted under 35 U.S.C. 154(b) by 413 days.

(21) Appl. No.: 11/236,601

(22) Filed: Sep. 28, 2005

(65) Prior Publication Data

US 2006/0073027 A1 Apr. 6, 2006

(30) Foreign Application Priority Data

Oct. 6, 2004 (JP) ..... 2004-293351

(51) Int. Cl.
*F04B 49/00* (2006.01)

(52) U.S. Cl. ..... 417/310; 418/133

(58) Field of Classification Search ..... 417/310, 417/423.14; 418/241–243, 133, 260, 261, 418/263, 132; 29/156.4, 888.025, 464, 466
See application file for complete search history.

(56) References Cited

U.S. PATENT DOCUMENTS 3,311,064 A * 3/1967 Eichele et al. ..... 418/133
3,421,413 A * 1/1969 Adams et al. ..... 418/80
3,479,962 A 11/1969 Pettibone
3,645,654 A * 2/1972 Niemiec et al. ..... 418/133
4,289,454 A * 9/1981 Iwata ..... 417/300
4,344,717 A * 8/1982 Merz ..... 403/14
4,382,756 A * 5/1983 Chronowski et al. ..... 418/133
4,401,417 A * 8/1983 Davis ..... 417/300
4,419,058 A * 12/1983 Franklin et al. ..... 418/133
4,505,655 A * 3/1985 Honaga et al. ..... 418/133
4,573,890 A * 3/1986 Hadama et al. ..... 418/108
4,842,500 A * 6/1989 Fujie et al. ..... 418/133
6,375,441 B1 * 4/2002 Ichizuki et al. ..... 418/30
6,599,111 B2 * 7/2003 Ohtaki et al. ..... 418/132
6,634,876 B2 * 10/2003 Osugi et al. ..... 418/260
6,666,670 B1 * 12/2003 Hartman et al. ..... 418/133
2002/0051721 A1 * 5/2002 Ohtaki et al. ..... 418/132

FOREIGN PATENT DOCUMENTS

DE 197 03 114 C2 11/2002
JP 62-271982 11/1987

* cited by examiner

*Primary Examiner*—Devon C Kramer
*Assistant Examiner*—Amene S Bayou
(74) *Attorney, Agent, or Firm*—Rabin & Berdo, P.C.

(57) ABSTRACT

A vane pump of the present invention is provided with a bearing convex portion (20) disposed in such a way to be raised from the bottom of a concave portion (13) of a cover (60) to form a bearing hole (25) and fitted into a central bore (27) of a first side plate (12), and a first locating pin (28) standing at the bottom of the concave portion (13), penetrating through the first side plate (12) and inserted into a cam ring (3).

7 Claims, 7 Drawing Sheets

VANE PUMP

The present invention claims priority to Japanese patent application No. 2004-293351, filed on Oct. 6, 2004, which is incorporated by reference in its entirety.

FIELD OF THE INVENTION

The present invention relates to a vane pump with a locating pin disposed in a cover.

BACKGROUND OF THE INVENTION

JP62-271982A published by the Japan Patent Office has disclosed a vane pump as mentioned below. The vane pump incorporates a cam ring into a body bore disposed in a body and also incorporates a rotor into the cam ring. A plurality of vanes is disposed inside the cam ring in such a way to freely move in the rotor and out of the rotor. The rotor is connected to a drive shaft and rotates with rotation of the drive shaft, as well as moves in and out the vanes disposed in the rotor along an inside face of the cam ring. In the process the rotor rotates, chambers defined by the neighboring vanes contract and expand. When the chamber expands, the vane pump is at the suction stroke, and when the chamber contracts, the vane pump is at the discharge stroke.

Further, a side plate is provided in one of side faces of the cam ring in a body side. The side plate has an outer diameter which is arranged to be equal to an outer diameter of the cam ring provided in the body bore. A discharge pressure or more of the pump is applied on the entire backside of the side plate to press the side plate on the side of the cam ring. This prevents a slight clearance between the cam ring and the side plate to widen due to pressures between the vanes, thus improving sealing properties of the chambers between the vanes.

In addition, a pair of locating pins are provided in a cover side of the vane pump in such a way to enter into a boundary portion between the cam ring and the body bore. Such arrangement determines a relative position relation between the body and the cover, as well as keeps the center of the body bore to be in line with the center of the cam ring and the side plate.

SUMMARY OF THE INVENTION

In the conventional vane pump, a pair of locating pins specify a relative position relation between the body and cover and also keep the center of the body bore to be in line with the center of the cam ring and the side plate. Such construction depends only on a standing position of the locating pin. In other words, unless a position to stand the locating pin is absolutely determined in a cover side face of the vane pump, the vane pump has the structure where a relative position between other members is not determined. Therefore, there is a problem with difficulty to form a pin bore for standing the locating pin.

An object of the present invention is to provide a vane pump which can relatively determine a position to stand a locating pin.

In order to achieve the above object, this invention provides a vane pump, the vane pump comprises a body including a body bore therein, a cover contacting the body to close the body bore, the cover being arranged to have a concave portion therein opened at a side of the body, a cam ring arranged to be in close contact with an inner peripheral surface of the body bore, a cylindrical rotor incorporated inside the cam ring and arranged to be co-axial with the cam ring, a plurality of vanes inserted into a plurality of vane grooves formed in a radial direction of the rotor, a rotating shaft penetrating axially through the rotor, wherein the rotating shaft has one end supported by a bearing hole disposed in the concave portion and rotates by a driving force of a drive source to rotate the rotor, a bearing supporting the rotating shaft, the bearing being disposed inside the body, a first side plate including a central bore and fitted into the concave portion, a bearing convex portion arranged so as to be raised from a bottom of the concave portion to form the bearing hole and fitted into the central bore of the first side plate, and a first locating pin standing from the bottom of the concave portion, penetrating through the first side plate, and inserted into the cam ring.

The details as well as other features and advantages of this invention are set forth in the remainder of the specification and are shown in the accompanying drawings.

DETAILED DESCRIPTION OF THE EMBODIMENT

Figure 1:
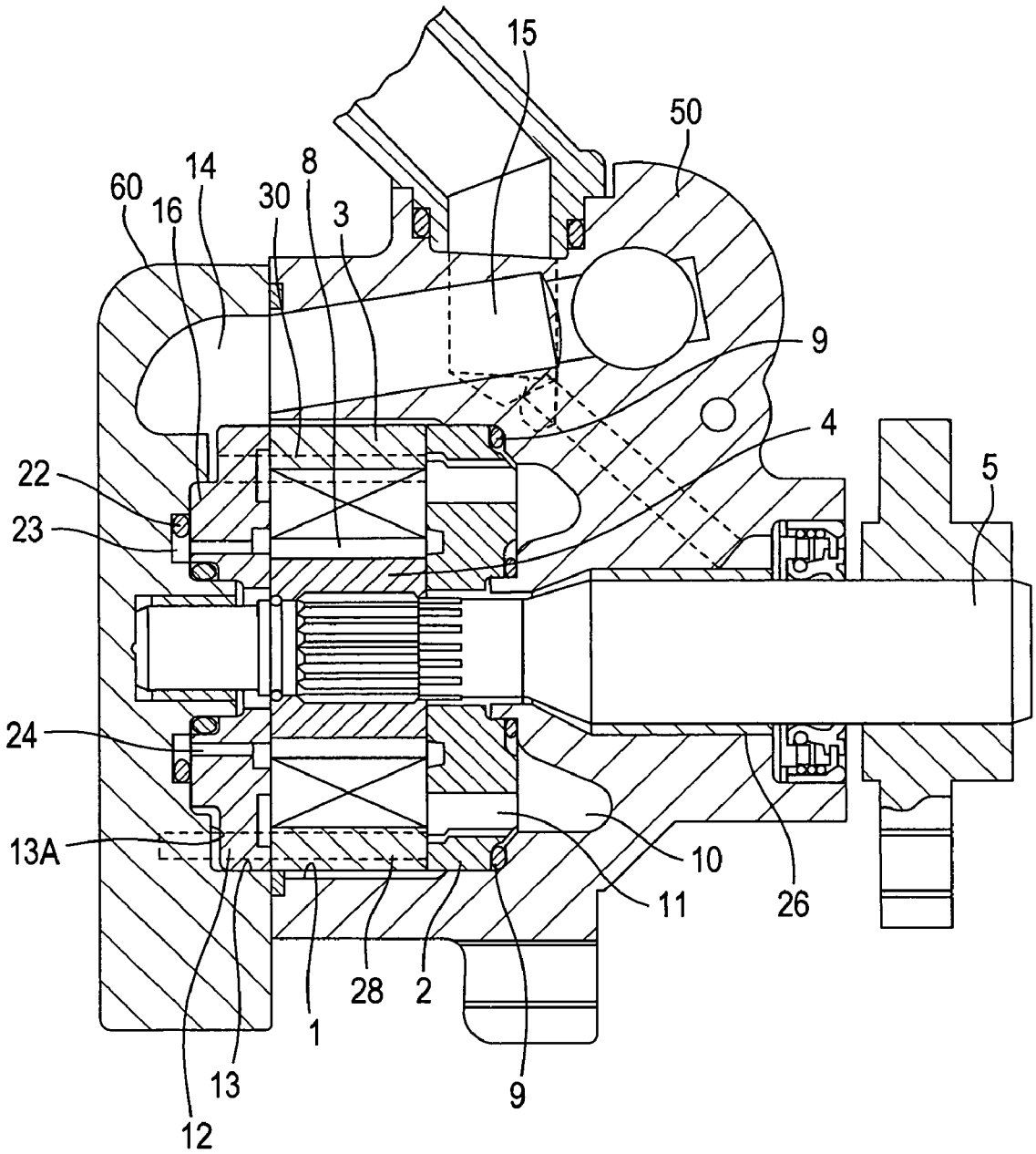
FIG. 1 is a cross-sectional view showing a vane pump.
Figure 3:
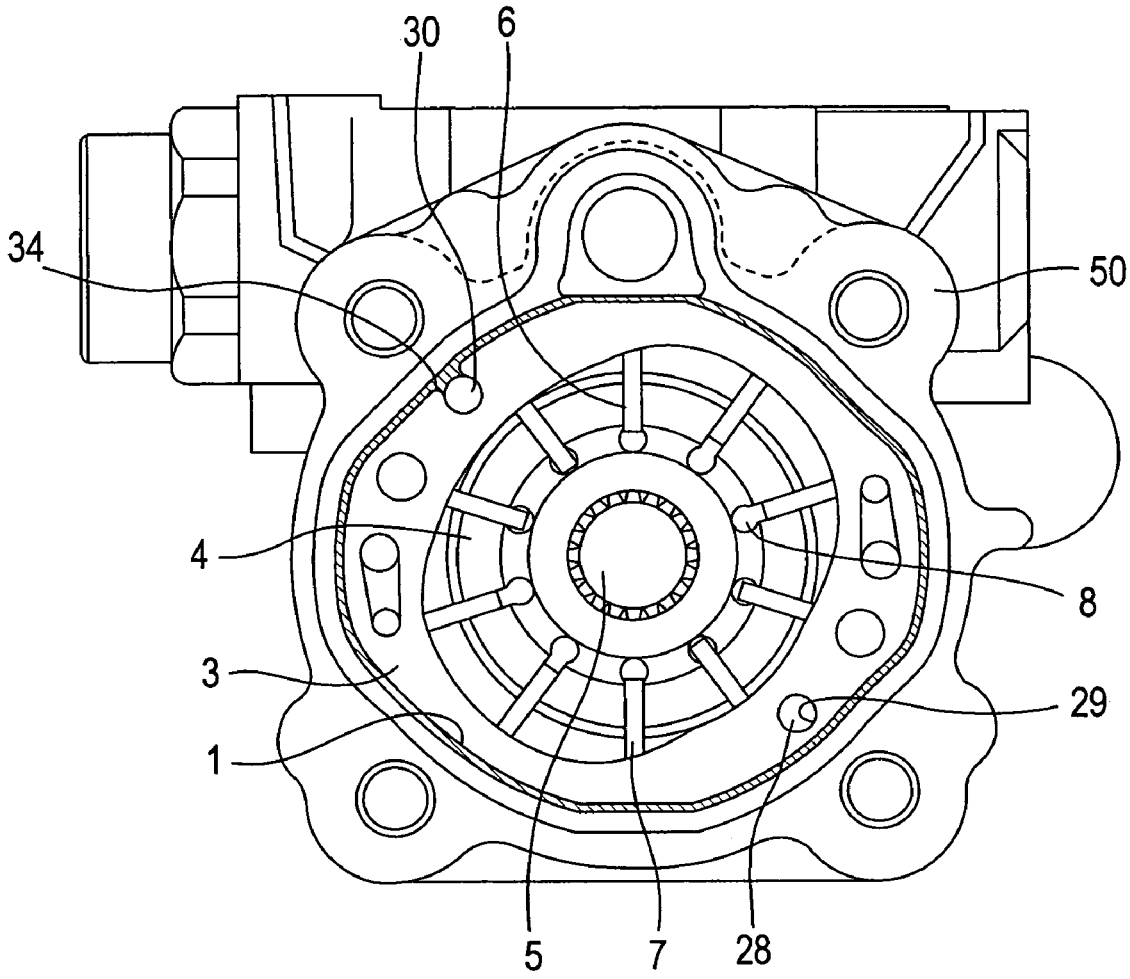
FIG. 3 is a front view showing a vane pump, with a cover removed.

The present invention will be explained with reference to the drawings as below. As shown in FIG. 1, a present embodiment is provided with a body 50 defining a body bore 1 therein and a cover 60 for covering the body bore 1. A front-side side plate 2 and a cam ring 3 are assembled in the body bore 1. A cross section of the body bore 1, as shown in FIG. 3, is not a complete circle. The cam ring 3 incorporates a rotor 4 therein. The rotor 4 rotates together with a rotating shaft 5 and can move in an axial direction of the rotating shaft 5. Vane grooves 6 for assembling vanes are formed radially and at an equal interval in a rotor 4 and the vanes 7 are incorporated into the vane grooves 6 so that the vanes 7 freely move in and out. The vane groove 6 defines a backpressure chamber 8 at the base end and a discharge pressure is introduced into this back pressure chamber 8.

Accordingly, when the rotor 4 rotates with the rotating shaft 5, the vanes 7 move in and out along the trace of the inner periphery of the cam ring 3, while a top end thereof is in contact with an inner face of the cam ring 3 by centrifugal force. Thereby, a suction stroke when chambers formed between each vane expand and a discharge stroke when the chambers contract are repeated. As shown in FIG. 1, a high-pressure area 10 defined by seal 9 is formed at the backside of the front side plate 2 disposed in a side face of the cam ring 3. This high-pressure area 10 is in hydraulic communication with a high-pressure bore 11 formed in the front side plate 2.

Figure 5:
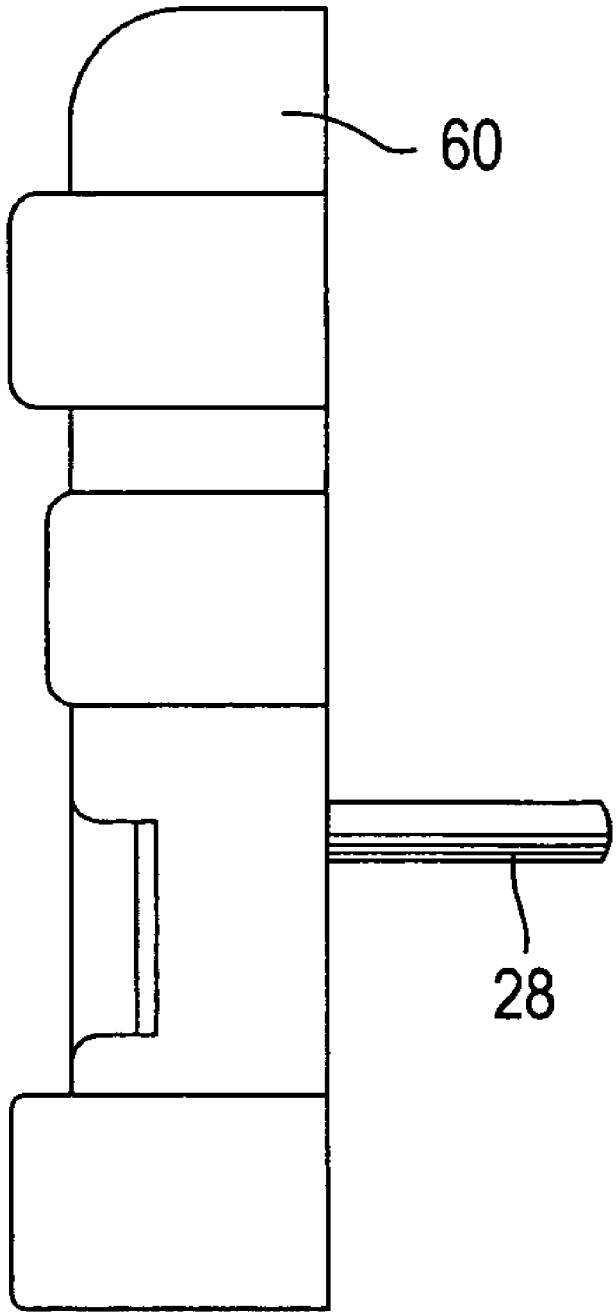
FIG. 5 is a side view showing a cover.
Figure 7:
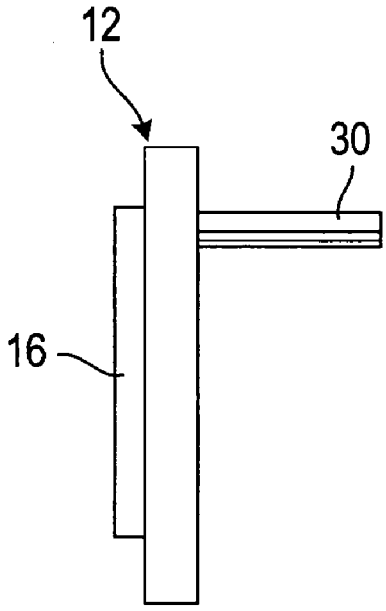
FIG. 7 is a side view showing a rear side plate.

When a side plate 12 is mounted to the cover 60, a position of a rotation direction and a position of a radial direction of the side plate 12 are determined by one pin 28 located in the cover 60 and the bore portion of the cover 60. Further, as shown in FIG. 5 and FIG. 7, positions of the cam ring 3 and the housing side plate 2 are determined by the pin 28 extending from the cover side and a pin 30 provided in the side plate 12. As shown in FIG. 1, a concave portion 13 for incorporating the rear side plate 12 is formed in the cover 60 to cover the body bore 1. A suction groove 14 is formed in a bottom 13A of the concave portion 13 and this suction groove 14 is in hydraulic communication with a suction port 15 provided in the body 50.

Figure 2:
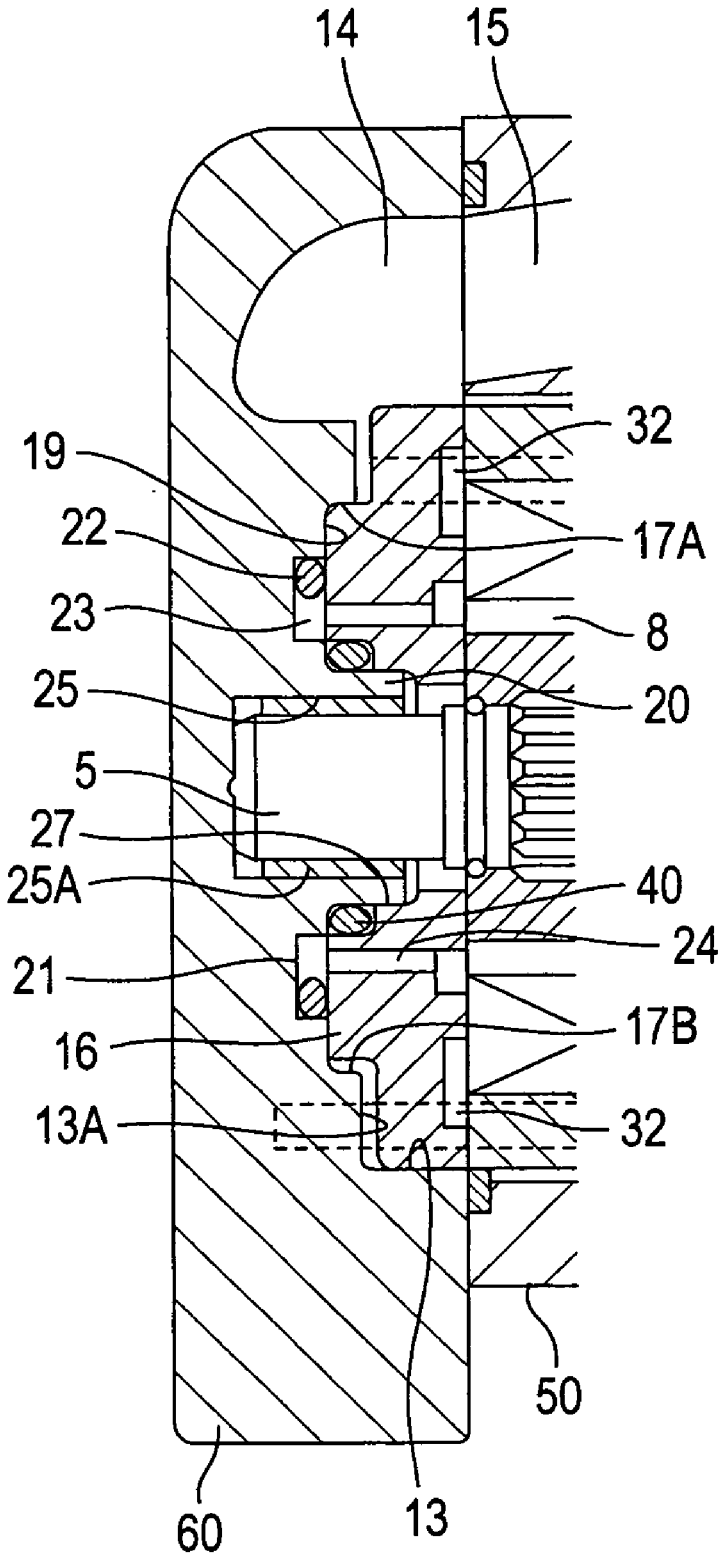
FIG. 2 is a partial cross-sectional view showing a vane pump.
Figure 8:
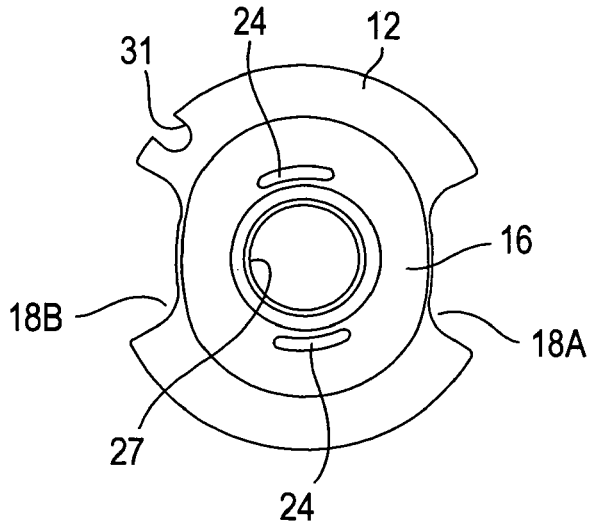
FIG. 8 is a rear elevation view showing a rear side plate.

As shown in FIG. 2, wall surfaces 17A and 17B for the fitting of a backside convex portion 16 of the rear side plate 12 stand at a side of the rear side plate 12 in a center side of the cover 60 away from the suction groove 14. As shown in FIG. 8, the backside convex portion 16 of the rear side plate 12 has an elliptical-shaped contact face with the cover 60 and a contact area with the cover 60 is increased to improve strength of the cover 60. However, in the present invention, it is not always required to form the backside convex portion in an elliptical shape. For example, the backside convex portion 16 may be in a completely circular shape.

In addition, as shown in FIG. 2, a bearing convex portion 20 of the cover 60 is fitted into an inner surface of the backside convex portion 16 to align the center of the rear side plate 12 with the center of the cover 60. The backside convex portion 16 is fitted into the wall surfaces 17A, 17B to cover an opening of the suction portion groove 14 as a clearance between the cover 60 and the rear side plate 12 with a seal 22 provided between the backside convex portion 16 and a high-pressure area concave portion 21 to be described later. A passage for suctioning is constructed of the suction groove 14 and the rear side plate 12 with the opening still covered.

Figure 4:
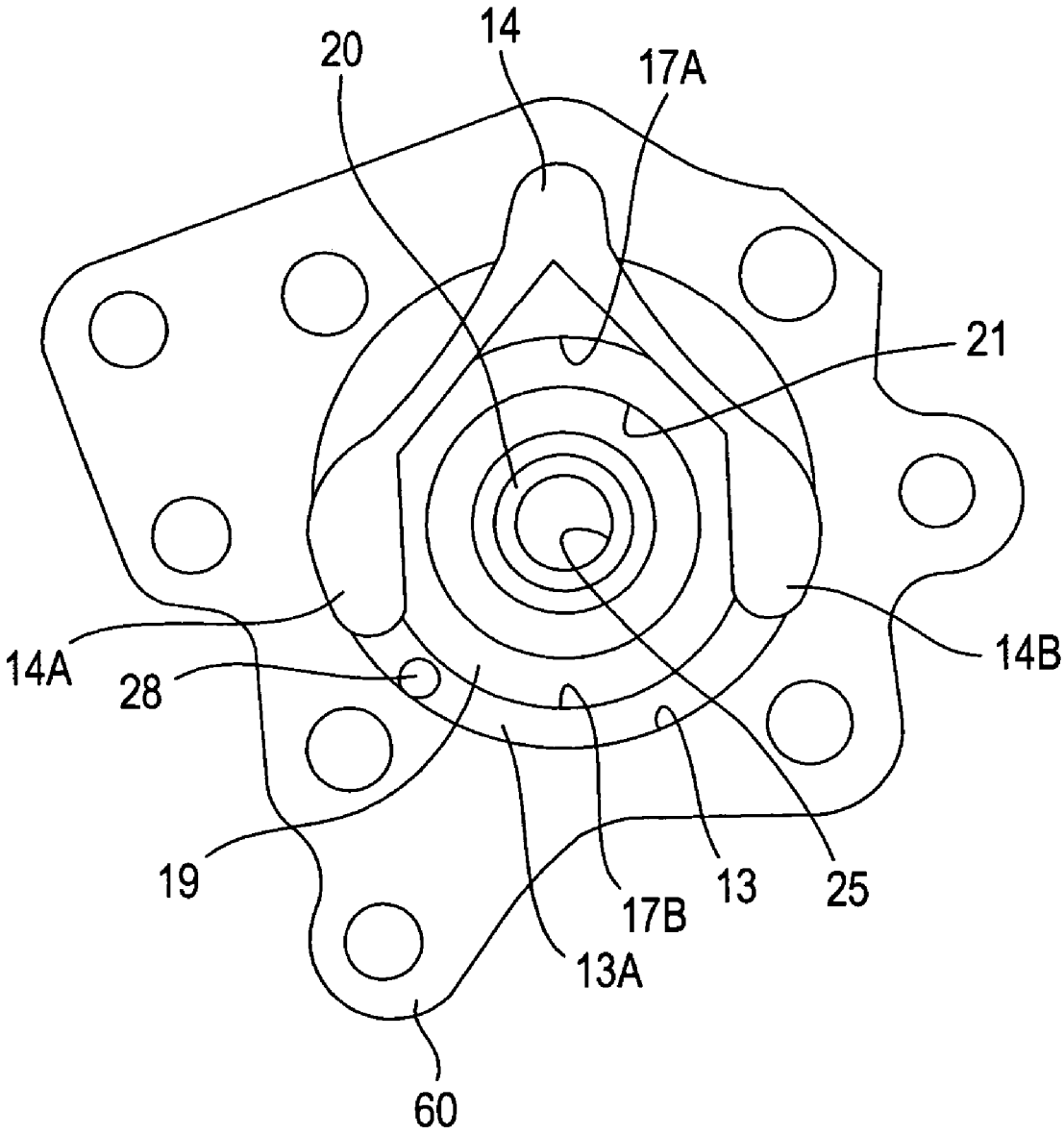
FIG. 4 is a front view showing a cover, with a rear side plate removed.
Figure 6:
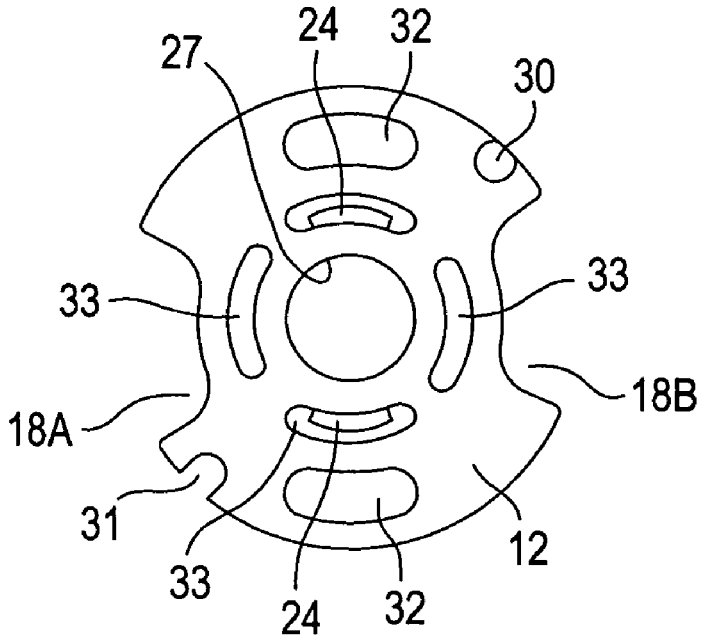
FIG. 6 is a front view showing a rear side plate.

Notch portions 18A, 18B for suction, as shown in FIG. 6, are formed in the rear side plate 12, adjacent to the backside convex portion 16 in the above-mentioned elliptical shape in a short axis direction. As shown in FIG. 4, a suction bore corresponding to a suction stroke position of the pump is constructed of the notch portions 18A, 18B and both end 14A, 14B of the suction groove 14.

Further, as shown in FIG. 2 and FIG. 4, the cover 60 is provided with a contact surface 19 which the backside convex portion 16 is in contact with, inside the wall faces 17A, 17B, and a high-pressure concave portion 21 is formed between the bearing convex portion 20 disposed in the center of the concave portion 13 and the contact face 19. The high-pressure area concave portion 21 is in hydraulic communication with a backpressure chamber of the rotor 4 to hold high pressure therein. A seal 22 is provided around the circumference of the high-pressure concave portion 21. The seal 22 performs a sealing function in cooperation with the backside convex portion 16 of the rear side plate 12 incorporated between the wall faces 17A, 17B.

The area thus defined by the seal 22 is a high-pressure area 23, which is, as shown in FIG. 1 and FIG. 2, in hydraulic communication with the backpressure chamber 8 via a high-pressure inlet bore 24 formed in the rear side plate 12. Accordingly, a pressure in the backpressure chamber 8 is introduced to the high-pressure area. Note that the pressure in the backpressure chamber 8 possibly increases to more than a discharge pressure of the pump. This is because when the vane 7 enters into the vane groove 6, a piton action of the vane 7 increases the pressure in the backpressure chamber 8.

In addition, a bearing hole 25 is formed at the central portion of the bearing convex portion 20, and the center of the bearing hole 25 is co-axial with the peripheral center of the bearing convex portion 20. And when the cover 60 is mounted to the body 50, the bearing hole 25 is arranged to be co-axial with a bearing 26 and the cam ring 3 disposed in the body 50. Further, a periphery of the bearing convex portion 20 and a central bore 27 formed in the rear side plate 12 are arranged to have generally the same diameter, and a seal 40 is interposed between them. This seal 40 seals the high-pressure area concave portion 21. Note that a bearing bush 25A is press-fitted into the bearing hole 25.

Further, as shown in FIG. 4, a locating pin 28 stands at the bottom 13A of a concave 13 of the cover 60. Note that, in order to make the locating pin 28 stand. The locating pin 28 may be press-fitted in a hole formed in the bottom 13A or may be fitted with a clearance. The top end of the locating pin 28, when the cover 60 is mounted to the body 50, as shown in FIG. 3, enters into a locating concave portion 29 provided in the cam ring 3. The locating pin 28 stands at the position except the suction groove 14, the contact face 19 and the high-pressure area concave portion 21 on the bottom 13A of the concave portion 13.

Figure 9:
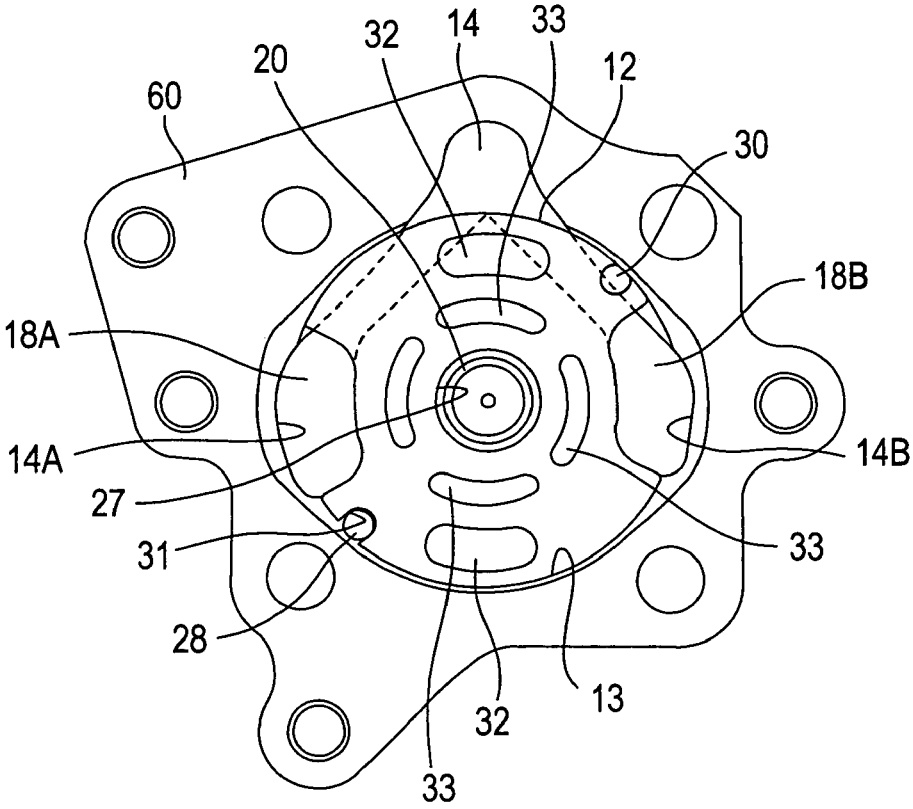
FIG. 9 is a front view showing a cover with a rear side plate assembled.

On the other hand, as shown in FIG. 6, a locating concave portion 31 is formed in the rear side plate 12 at the side opposite to the locating pin 30. The locating pin 28 standing at the bottom 13A of the cover 60 penetrates through the locating concave portion 31. And in a state where the locating pin 28 penetrates through the locating concave portion 31, when the bearing convex portion 20 formed in the concave portion 13 is fitted into the central bore 27 of the rear side plate 12, as shown in FIG. 9, the position of the rotational direction and the position of the radial direction of the rear side plate 12 are determined by the pin 28 and the concave portion 13. That is, a relative position of a pair of pressure inlet portions 32 or backpressure inlet grooves 33 is specified. Note that the locating pin 30 may be press-fitted therein or fitted with a clearance. Further, the position of the cam ring 3 is determined by the pin 28 projected from the side of the cover 60 and the pin 30 provided in the rear side plate 12.

When the locating pin 28 standing at the bottom 13A of the cover 60 is fitted into the locating concave portion 31 of the rear side plate 12 and the rear side plate 12 is rotated around the locating pin 28, rotation trace of the center of the central bore 27 goes through the center of the bearing convex portion 20. With such arrangement, it is easier to assemble the rear side plate 12 into the concave portion 13. That is, when the rear side plate 12 is assembled into the concave portion 13, firstly the locating pin 28 is fitted into the locating concave portion 31. In this state, the rear side plate 12 is rotated around the locating pin 28 by gripping the locating pin 30 of the rear side plate 12 and the central bore 27 is brought close to the bearing convex portion 20. Then, as described above, since the rotation trace of the center of the central bore 27 is in line with the center of the bearing convex portion 20, it is easy to align the central bore 27 with the bearing convex portion 20 by swinging the rear side plate 12 in the rotational direction.

As described above, the locating pin 30 standing at the rear side plate 12, when the cover 60 is mounted to the body 50, as shown in FIG. 3, is fitted into the locating concave portion 34 formed in the cam ring 3. Accordingly, the relative position of the cam ring 3 is specified by the locating pin 28 standing at the bottom 13A and the locating pin 30 standing at the rear side plate 12, thus preventing rotation of the cam ring 3 inside the body bore 1.

In addition, since, among a pair of locating pins, one locating pin 28 stands at the bottom 13A of the concave portion 13 in the cover 60, and the other locating pin 30 stands at the rear side plate 12 like the present embodiment, a position where the locating pin 28 stands can be freely set, for example. If the locating pin 30 stands inside the bottom 13A of the cover 60, it is required to avoid the position of the suction groove 14. However, when the vane pump of a type where the suction groove 14 is formed in the cover 60 has no space to make a pin stand inside concave portion 13, the position of standing the pin is inevitably determined. However, degrees of freedom in designing are assured by standing one locating pin 28 at the bottom 13A as the inevitable position of the pin 28 and by standing the other locating pin 30 at the rear side plate 12 having higher degrees of freedom of the locating.

Further, when the locating pin 30 is arranged to stand at a position other than the position of the suction groove 14, the standing position is at an outer side from the suction groove 14. When the locating pin 30 is disposed at an outer side from the suction groove 14, the position of the locating concave portion 34 of the corresponding cam ring 3 is also required to be at an outer side from the suction groove 14. As the locating concave portion 34 of the cam ring 3 is positioned at the further outer side, an outer diameter of the cam ring increases the more. When the outer diameter of the cam ring increases, the entire size of the pump increases. However, as shown in the present invention, when the locating pin 28 is arranged to stand at the bottom 13A of the concave portion 13 in the cover 60, and the other locating pin 30 is arranged to stand at the rear side plate 12, both the locating pins 28, 30 can be positioned at a relatively central side to prevent the pump from being large in size.

When the rotating shaft 5 is rotated by power of a power source, the rotor 4 rotates with it. When the rotor 4 rotates, the vanes 7 disposed in the rotor 4 move in and out along the inner face of the cam ring 3, the chambers defined by the vanes 7 expand and contract. When the chambers expand, the suction stroke occurs, where an operating oil is suctioned from a suction passage formed of a suction port 15, the suction groove 14, and the like, and when the chambers contract, the discharge stroke occurs.

At this time, the high-pressure outlet bore 11 formed in the front side plate 2 and the pressure inlet portion 32 of the rear side plate 12 deviate in the circumferential direction and their opposing position is not determined accurately, that possibly causes fluctuations. That is, since the high-pressure outlet bore 11 and the pressure inlet portion 32 are formed at a position corresponding to the discharge stroke of the pump, the high pressure is always introduced thereto. This high pressure is applied to both sides of the vane 7 passing the high-pressure outlet bore 11 and the pressure inlet portion 32. Under this situation, when the high-pressure outlet bore 11 and the pressure inlet portion 32 deviate at a relative position of the circumferential direction, the tiling when the high pressure acts on both the sides deviates, this fining deviation causes fluctuations. However, since in this embodiment, a relative position between the rear side plate 12 and the cam ring 3, and the front side plate 2 is specified, the relative position in the circumferential direction does not deviate, the fluctuations are less likely to occur. And in a case the relative position between the suction bore and the high-pressure outlet bore 11 or the pressure inlet portion 32 deviates, the fluctuations occur, which can be prevented by the present embodiment.

The present invention is not limited to the above-described preferred embodiment, but it is apparent to those skilled in the art that the present invention includes various improvements and modifications within the scope of the technical concept of the present invention as defined in the appended clams.

What is claimed is:

1. A vane pump, comprising:

a body including a body bore therein;

a cover contacting the body to close the body bore, the cover being arranged to have a concave portion therein opened at a side of the body;

a cam ring arranged to be in close contact with an inner peripheral surface of the body bore;

a cylindrical rotor incorporated inside the cam ring and arranged to be co-axial with the cam ring;

a plurality of vanes inserted into a plurality of vane grooves formed in a radial direction of the rotor;

a rotating shaft penetrating axially through the rotor, wherein the rotating shaft has one end supported by a bearing hole disposed in the concave portion and rotates by a driving force of a drive source to rotate the rotor;

a bearing supporting the rotating shaft, the bearing being disposed inside the body;

a first side plate including a central bore and fitted into the concave portion;

a bearing convex portion arranged so as to be raised from a bottom of the concave portion to form the bearing hole and fitted into the central bore of the first side plate;

a first locating pin standing from the bottom of the concave portion, penetrating through the first side plate, and inserted into the cam ring, a top end of the first locating pin being disposed within the cam ring;

a second side plate provided inside the body bore and being opposite to the first side plate so that the rotor is placed between the first side plate and the second side plate;

a high-pressure outlet portion disposed in the second side plate to send out a pressure from chambers defined by the neighboring vanes;

a pressure inlet portion disposed in the first side plate to balance pressures applied to the chambers defined by the neighboring vanes in an axial direction from both sides of the rotor; and a second locating pin raised from the first side plate and inserted into the cam ring, wherein:

a relative position between the pressure inlet portion and the high-pressure outlet portion is maintained by the first locating pin and the second locating pin.

2. The vane pump according to claim 1, wherein:

the concave portion includes a part of a bottom of a suction flow passage for supplying a fluid to the chambers defined by the neighboring vanes, and the first locating pin stands at a position avoiding the suction flow passage.

3. The vane pump according to claim 1, wherein:

the first side plate includes a locating concave portion to fit the first locating pin, wherein:

the locating concave portion is disposed at a position where, in a state the first locating pin is fitted into the locating concave portion, when the first side plate is rotated around the first locating pin, a trace of a center of the first side plate passes a center of the bearing convex portion.

4. The vane pump according to claim 1, wherein the cover closes the body bore in an axial direction of the rotating shaft.

5. The vane pump according to claim 1, wherein a top end of the second locating pin is disposed within the cam ring.

6. The vane pump according to claim 1, wherein a rear axial end of the rotating shaft is blocked by the cover, with the rear axial end being received within the bearing hole of the cover.

7. The vane pump according to claim 6, wherein the body bore extends along an axial direction of the rotating shaft, the body bore including a first end adjacent to the blocked rear axial end of the rotating shaft and a second end opposite to the first end, the cover closing the first end of the body bore.

* * * * *